United States Patent [19]

Koseki et al.

[11] 4,205,459

[45] Jun. 3, 1980

[54] APPARATUS FOR REGENERATING AN ADSORBENT

[75] Inventors: Yasuo Koseki, Hitachi; Toyohiko Kaneko, Katsuta; Masayoshi Kubota; Sankichi Takahashi, both of Hitachi, all of Japan

[73] Assignees: Hitachi, Ltd.; Hitachi Chemical Co., both of Tokyo, Japan

[21] Appl. No.: 884,423

[22] Filed: Mar. 8, 1978

[30] Foreign Application Priority Data

Mar. 14, 1977 [JP] Japan ..... 52/27034
Mar. 14, 1977 [JP] Japan ..... 52/27035

[51] Int. Cl.[2] ..... F26B 17/22

[52] U.S. Cl. ..... 34/166; 34/180; 34/182; 34/80; 34/209; 432/99; 432/102

[58] Field of Search ..... 34/166, 167, 168, 173, 34/179–183, 80, 209, 216; 252/411 R; 432/96, 99, 101, 102

[56] References Cited

U.S. PATENT DOCUMENTS

| | | | |
|---|---|---|---|
| 1,371,546 | 3/1921 | Bollmann | 34/182 |
| 2,934,830 | 5/1960 | Zvejmeks | 34/182 |
| 3,075,298 | 1/1963 | Schaub | 34/166 |
| 3,973,884 | 8/1976 | Terminiello | 34/182 |
| 4,008,994 | 2/1977 | Numasaki et al. | 432/99 |

FOREIGN PATENT DOCUMENTS

| | | |
|---|---|---|
| 50-86495 | 7/1975 | Japan . |
| 51-45693 | 4/1976 | Japan . |

*Primary Examiner*—Larry I. Schwartz
*Attorney, Agent, or Firm*—Thomas E. Beall, Jr.

[57] ABSTRACT

In regenerating an adsorbent by eliminating water and an adsorbed matter which are contained therein, the adsorbent is indirectly heated while descending within a drying furnace and is indirectly heated while ascending within a regenerating furnace in order to prevent the adsorbent from scattering due to water vapor and the adsorbed gas separated by the heating of the adsorbent and to prevent the adsorbent from burning itself due to heat.

16 Claims, 3 Drawing Figures

APPARATUS FOR REGENERATING AN ADSORBENT

LIST OF PRIOR ART (37 CFR 1.56 (a))

The following references are cited to show the state of the art: (1) Japanese Patent Application Public-disclosure No. 86495/1975 (2) Japanese Patent Application Public-disclosure No. 45693/1976

BACKGROUND OF THE INVENTION

This invention relates to an apparatus and a method for regenerating an adsorbent such as active carbon and zeolite by heating.

In order to eliminate organic matter, for example dodecylbenzensulfonate and phenol, from industrial waste water, an adsorbent which adsorbs them is used. To the end of reclaiming the adsorbent which has adsorbed the matter and water, it is necessary to eliminate the adsorbed matter and water from the adsorbent by heating the adsorbent. The temperature required for eliminating the water content from the adsorbent is 100° C., whereas the temperature required for desorbing the adsorbed matters from the adsorbent is 600° C. to 800° C.

Japanese Patent Application Public-disclosure No. 86495/1975 discloses a method and an apparatus for regenerating an adsorbent wherein the drying of the adsorbent and the regeneration thereof are individually executed. In the method and apparatus, however, furnaces for the respective steps are installed in a manner to be long in the horizontal direction, and the adsorbent having entered the drying furnace is heated while flowing horizontally, so that inevitably the adsorbent and water vapor generated therefrom flow in the same direction. This leads to the disadvantage that the dried adsorbent scatters in the horizontal direction together with the water vapor. Likewise, in the regenerating furnace which is long in the horizontal direction, the adsorbent scatters in the horizontal direction along with desorbed gases.

Japanese Patent Application Public-disclosure No. 45693/1976 discloses a method and an apparatus for regenerating an adsorbent wherein the adsorbent is dried and regenerated by directly heating it with a high-temperature gas. In the case of performing the drying and the regeneration by the direct heating, there are such disadvantages that part of the surface of the adsorbent is brought to a high temperature by the high-temperature gas, so the adsorbent itself burns, and that the adsorbent from which adsorbed matter has been eliminated adsorbs impurities in the high-temperature gas, so the purity of the adsorbent lowers. Further, according to the cited reference, the drying and the regeneration are executed in the course in which the adsorbent is caused to descend vertically. This leads to the disadvantage that the desorbed gases ascending are adsorbed to the adsorbent again within a furnace, so the adsorption performance of the adsorbent is degraded.

SUMMARY OF THE INVENTION

An object of this invention is to provide a method and an apparatus for regenerating an adsorbent wherein the adsorbent is not scattered by water vapor or a desorbed gas produced therefrom.

Another object of this invention is to provide a method and an apparatus for regenerating an adsorbent wherein the adsorbent itself does not burn in the step of drying and the step of regenerating the adsorbent.

Still another object of this invention is to provide a method and an apparatus for regenerating an adsorbent wherein heating at a high thermal efficiency can be executed in the drying and regeneration of the adsorbent.

According to the invention, there are provided a method and an apparatus for regenerating an adsorbent as have the following features:

(1) A drying furnace and a regenerating furnace are installed in a manner to be long in the vertical direction, and an adsorbent descending within the drying furnace is heated and dried, while the adsorbent ascending within the regenerating furnace is heated and regenerated. Since the adsorbent introduced into the drying furnace is comparatively heavy on account of a high water content, it is not scattered by ascending water vapor in attendance thereupon. Especially, an expedient of heating in which the temperature of the adsorbent in the uppermost part of the drying furnace is about 100° C. and in which the temperature becomes still higher in lower parts is desirable for the reason that water vapor is produced from the adsorbent in only the uppermost part and that since the adsorbent in the vicinity thereof is heavy, the adsorbent is not scattered by the water vapor in attendance thereupon. In addition, the dried adsorbent introduced into the regenerating furnace is heated while ascending, so that the adsorbent is not scattered by an ascending desorbed gas in attendance thereupon owing to the weight of its own. Especially, with an expedient of heating in which the temperature of the adsorbent in the uppermost part of the regenerating furnace is 600° C. to 800° C. and in which the temperature becomes lower in lower parts, the gas is desorbed from only the adsorbent in the uppermost part. Therefore, the adsorbent is more perfectly prevented from being scattered by the desorbed gas in attendance thereupon. Simultaneously therewith, since the desorbed gas is not adsorbed to the adsorbent again, the degradation of the adsorption power of the adsorbent can be prevented.

(2) Since the adsorbent in the drying furnace and the regenerating furnace is indirectly heated by a high-temperature gas, the local burning of the adsorbent itself can be prevented. Further, in case of the indirect heating, the adsorbent is not stained by impurities contained in the high-temperature gas, and hence, the lowering of the purity of the adsorbent can be prevented.

(3) In subjecting the adsorbent to the indirect heating, the drying furnace and the regenerating furnace are built into a double structure consisting of an inner container and an outer container so as to indirectly heat the adsorbent moving in the inner container by the high-temperature gas which moves in the interspace between the inner container and the outer container and also by the high-temperature gas which flows through heat transmitting tubes penetrating the inner container, so that the thermal efficiency is enhanced. As the result, the temperature of 600° C. required for regenerating the adsorbent can be reached in a short time, and the quantity of regenerating treatment of the adsorbent can be increased. Especially, when the heat transmitting tubes are disposed in a plurality of stages along the axis of the furnace and they are arranged so that the heat transmitting tubes of the adjacent stages may be orthogonal to each other, the thermal efficiency can be further raised.

(4) The high-temperature gas for heating the adsorbent is introduced from above into the interspace between the outer container and the inner container of the regenerating furnace and heats the adsorbent in the inner container successively from upper parts to lower parts, whereupon it is introduced from below into the interspace between the outer container and the inner container of the drying furnace and heats the adsorbent in the inner container successively from lower parts to upper parts. Therefore, the temperature of the adsorbent reaches the optimum temperatures for drying and regeneration in a short time and effectively, and the thermal efficiency rises.

(5) There is disposed a heat exchanger which preheats air taken from the outside into a combustor in order to produce the high-temperature gas, by the use of the adsorbent taken out of the regenerating furnace and lying at a comparatively high temperature. Accordingly, the thermal efficiency rises.

(6) Since vanes for stirring the adsorbent are disposed in the drying furnace and the regenerating furnace, the adsorbent undergoes horizontal forces and the temperature distribution of the adsorbent at an identical level can be made uniform. As the result, it is avoidable that the adsorbent is taken out without being regenerated on account of a low temperature or that the adsorbent itself burns on account of a high temperature.

When the vanes are inclined relative to the rotational direction thereof so as to bestow dynamic lift on the adsorbent descending within the drying furnace and the adsorbent ascending within the regenerating furnace, the adsorbent can be moved at a constant speed while balancing the dynamic lift to the weight of the adsorbent itself.

(7) When the distance between the heat transmitting tubes of the adjacent stages is made equal to the distance between the vanes of the adjacent stages, and besides, the heat transmitting tubes of the adjacent stages and the vanes of the adjacent stages are respectively arranged in a manner to be orthogonal, a rotary shaft on which the vanes are mounted can be easily assembled and detached within the furnace in which the heat transmitting tubes are installed. Therefore, the maintenance of the apparatus is simple.

Further objects and advantages of the invention will be apparent from a reading of the following detailed description of the preferred embodiments taken in conjunction with the accompanying drawings.

DESCRIPTION OF THE PREFERRED EMBODIMENTS

Figure 1:
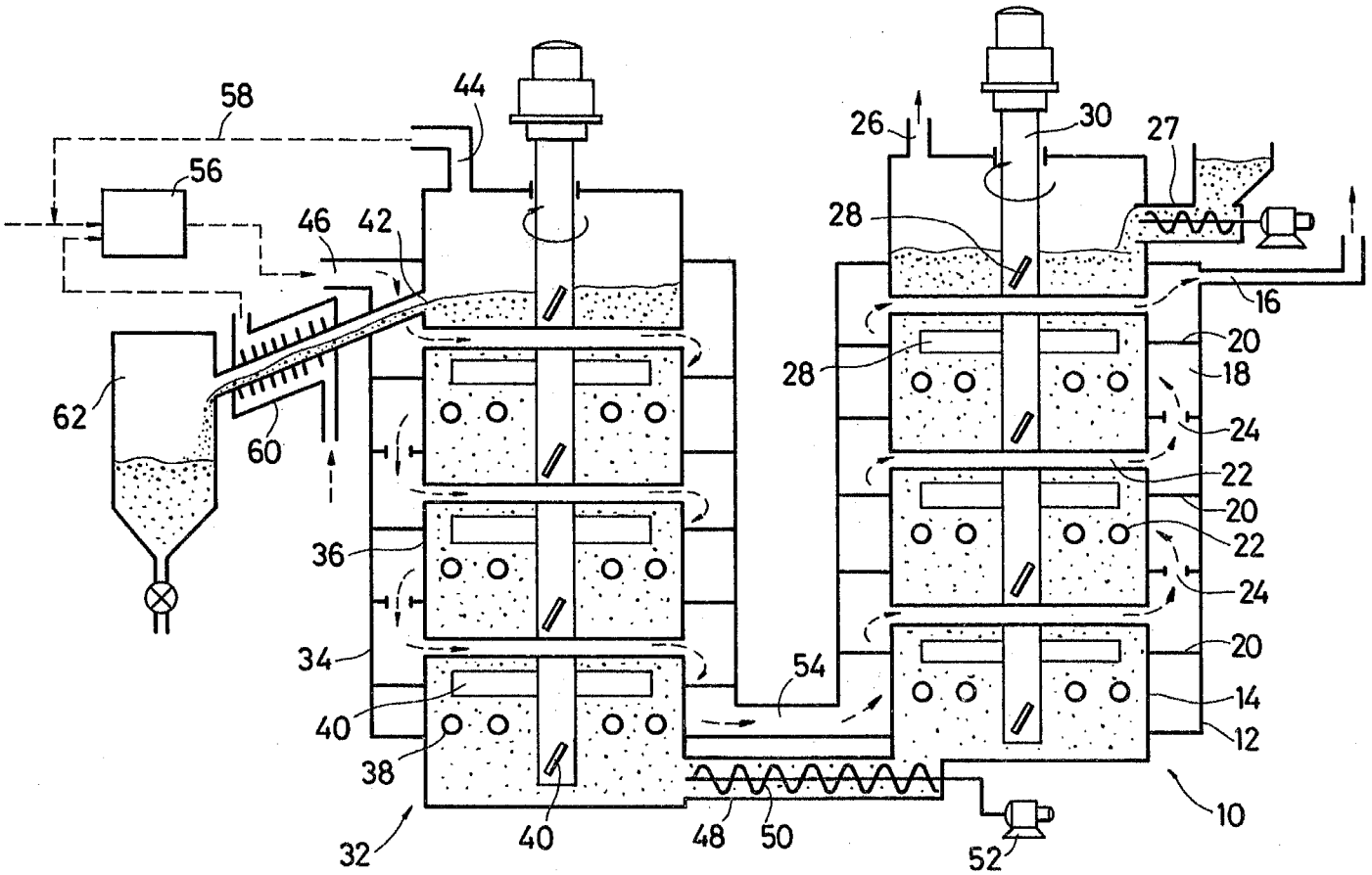
FIG. 1 is a sectional view showing an embodiment of this invention.
Figure 2:
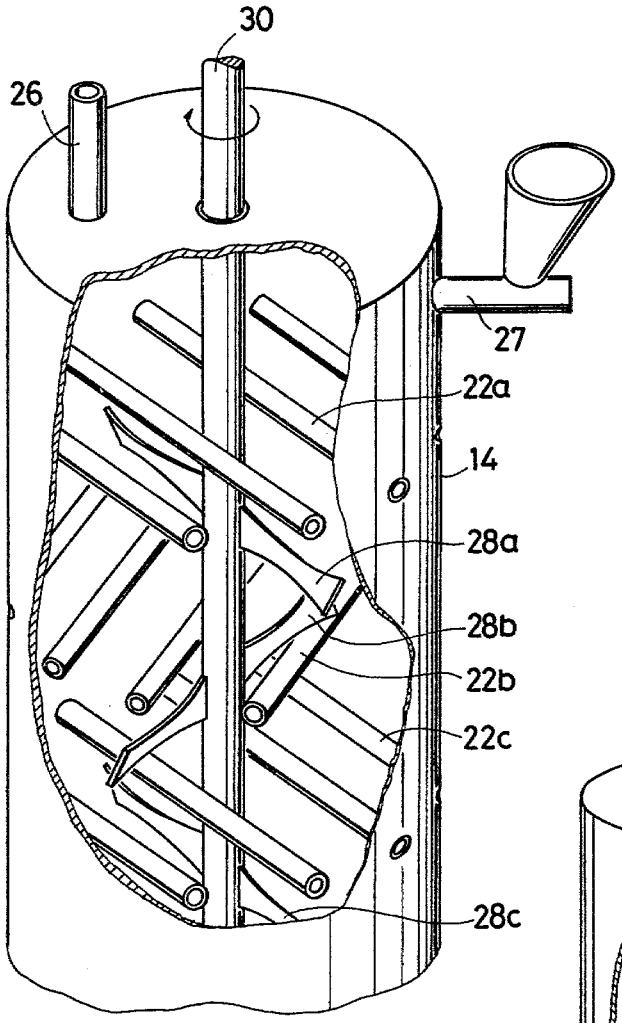
FIG. 2 is a perspective view with part of a cylindrical inner container of a drying furnace broken away, and shows the arrangement within the cylindrical inner container, of the heat transmitting tubes and vanes for agitation.
Figure 3:
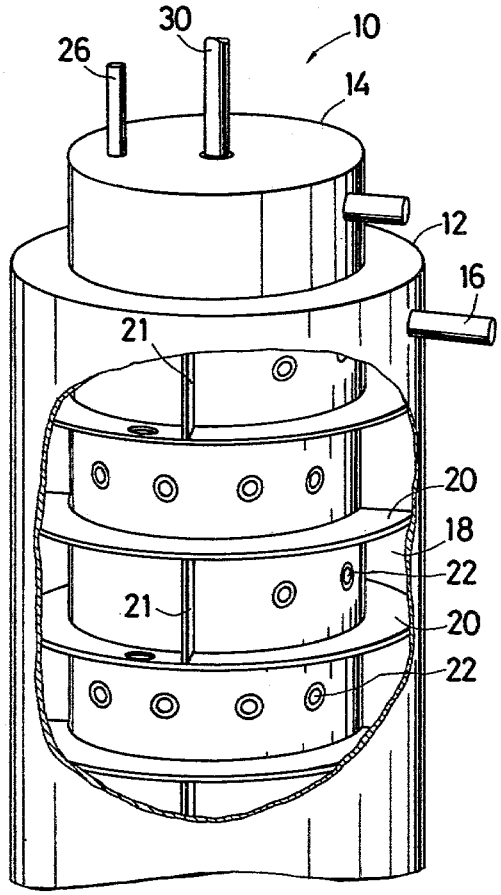
FIG. 3 is a perspective view showing the structure of the interspace between the cylindrical inner container and a cylindrical outer container of the drying furnace.

FIG. 1 shows an apparatus for regenerating an adsorbent according to this invention. FIGS. 2 and 3 are detailed views of the apparatus. As illustrated in the figures, a drying furnace 10 consists mainly of a cylindrical outer container 12 and a cylindrical inner container 14.

The diameter of the cylindrical inner container 14 is smaller than that of the cylindrical outer container 12, and both the containers are concentrically arranged. The two containers 12 and 14 are installed in a manner to be long in the vertical direction. An upper part of the cylindrical outer container 12 is provided with an outlet 16 for a high-temperature gas having been used for heating the adsorbent.

The interspace defined between the cylindrical inner container 14 and the cylindrical outer container 12 is divided into a plurality of spaces 18 in the axial direction by means of partition plates 20. Each space 18 is further divided by another partition plate 21 into two spaces which communicate through heat transmitting tubes 22. The partition plates 20 are provided with holes 24 so that all the spaces formed between the cylindrical inner container 14 and the cylindrical outer container 12 may join in series. An upper part of the cylindrical inner container 14 has an outlet 26 for water vapor produced from the adsorbent, and a port 27 for supplying the adsorbent.

The arrangement of the heat transmitting tubes 22 which penetrate the cylindrical inner container 14 and both ends of which are open to the spaces 18 between the cylindrical inner container 14 and the cylindrical outer container 12, as well as adsorbent stirring vanes 28 which are disposed within the cylindrical inner container 14, is illustrated in detail in FIG. 2. The heat transmitting tubes 22 are disposed in a plurality of stages at equal intervals in the axial direction, and the heat transmitting tubes **22*a* and the heating transmitting tubes 22*b* of the adjacent stages and the heat transmitting tubes 22*b* and the heat transmitting tubes 22*c* of the same are respectively arranged in directions orthogonal to each other. A shaft 30 is rotatably mounted within the cylindrical inner container 14, and the vanes 28 are disposed thereon in a plurality of stages at equal intervals. The vane 28*a* and the vane 28*b* of the adjacent stages and the vane 28*b* and the vane 28*c* of the same are respectively arranged in directions orthogonal to each other. Moreover, the distance between the heat transmitting tubes 22 of the adjacent stages and the distance between the vanes 28 of the adjacent stages are equal. The respective vanes 28 are slightly inclined with respect to the rotational direction of the shaft 30, and the adsorbent descending in the cylindrical inner container 14** is endowed with dynamic lift.

The structure of a regenerating furnace 32 is substantially the same as that of the drying furnace 10. For example, the constructions, arrangements and dimensions of a cylindrical outer container 34, a cylindrical inner container 36, heat transmitting tubes 38, vanes 40, etc. are identical. A difference is that, whereas the upper part of the cylindrical inner container 14 of the drying furnace 10 has the water vapor-taking out port 26 and the adsorbent-feeding port 27, an upper part of the cylindrical inner container 36 of the regenerating furnace 32 is provided with a port 42 for taking out the regenerated adsorbent and a still higher part thereof with a port 44 for taking out the desorbed gas. Another difference is that, whereas the upper part of the cylindrical outer container 12 of the drying furnace 10 has the outlet 16 for the high-temperature gas, an upper part of the cylindrical outer container 34 of the regenerating furnace 32 is provided with an inlet 46 for the high-temperature gas.

The cylindrical inner container 14 of the drying furnace 10 and the cylindrical inner container 36 of the regenerating furnace 32 communicate with each other in their bottom parts by means of a pipe 48. Disposed within the pipe 48 is a screw feeder 50 which serves to feed the adsorbent from the drying furnace 10 to the regenerating furnace 32, and which is driven by a motor 52.

The cylindrical outer container 12 of the drying furnace 10 and the cylindrical outer container 34 of the regenerating furnace 32 communicate with each other in their bottom parts by means of a pipe 54. The high-temperature gas is fed from the regenerating furnace 32 to the drying furnace 10 through the pipe 54.

A combustor 56 serves to produce the high-temperature gas for heating the adsorbent. The fuel of the combustor 56 may be an ordinary combustible. The gas desorbed from the adsorbent may be fed to the combustor 56 by a pipe 58 so as to utilize it as part of the fuel. Air to be fed to the combustor 56 is preheated within a heat exchanger 60 by the adsorbent which has been taken out of the regenerating furnace 32 and which is in the course of being fed to a storage tank 62.

During the descent in the cylindrical inner container 14 of the drying furnace 10, the adsorbent is indirectly heated by the high-temperature gas which ascends in the spaces 18 between the cylindrical inner container 14 and the cylindrical outer container 12 and by the high-temperature gas which passes through the heat transmitting tubes 22. The heating is adjusted so that the temperature of the upper part of the cylindrical inner container 14 may become about 100° C. and that the temperature of the lower part thereof may become about 300° C. In consequence, water having been contained in the adsorbent is separated as water vapor in an upper layer part of the adsorbent within the cylindrical inner container 14. The temperature of the adsorbent increases as it descends, and when it has reached about 300° C., it is fed to the bottom part of the cylindrical inner container 36 of the regenerating furnace 32 through the pipe 48. The adsorbent having entered the cylindrical inner container 36 is caused to ascend in the cylindrical inner container 36 by the transport force of the screw feeder 50 and the dynamic lift of the vanes 40. During the ascent, the adsorbent is heated from about 300° C. to 600° C.–800° C. by the high-temperature gas which descends in the interspace between the cylindrical inner container 36 and the cylindrical outer container 34. The gas is separated from the adsorbent heated to 600° C.–800° C.

EXAMPLE

A cylindrical inner container used had a diameter of 206 mm and a height of 450 mm. The rate of regenerating treatment of an adsorbent was 1.5 kg/hour. Under these conditions, the regeneration was carried out. Then, 99 weight-% of the adsorbent was recovered. That is, the regeneration loss was 1.0% by weight. It was found that 0.5% of the regeneration loss amounting to 1% was attributed to the scattering and that the remaining 0.5% was attributed to the combustion of the adsorbent itself.

What is claimed is:

1. An apparatus for regenerating an adsorbent, comprising:

a drying furnace for removing water contained in the adsorbent, said drying furnace having at its upper part a port for feeding the adsorbent and an outlet for water vapor produced from the adsorbent and at its lower part a port for taking out the adsorbent, a regenerating furnace for removing adsorbed matter from the adsorbent subjected to drying, said regenerating furnace having at its upper part a port for taking out the adsorbent regenerated and a port for taking out the gas produced from the adsorbent and at its lower part a port for feeding the adsorbent, communicating means for conveying adsorbent from the lower part of said drying furnace to the lower part of said regenerating furnace through the port for taking out the adsorbent from said drying furnace and the port for feeding the adsorbent into said regenerating furnace, and a heat source for indirectly heating the adsorbent in said drying furnace and in said regenerating furnace.

2. An apparatus for regenerating an adsorbent, comprising:

a combustor for producing a high-temperature gas for heating the adsorbent, a drying furnace for removing water contained in the adsorbent, and including;

(1) a first cylindrical outer container which has an outlet for the high-temperature gas at an upper part thereof, and (2) a first cylindrical inner container which has a diameter smaller than that of said first cylindrical outer container and is arranged concentrically with said first cylindrical outer container, and which has at its upper part a port for feeding the adsorbent and an outlet for water vapor produced from the adsorbent, and a regenerating furnace for removing adsorbed matter contained in the adsorbent, and including;

(1) a second cylindrical outer container which has at its upper part a port for taking the high-temperature gas from said combustor thereinto, and a bottom part of which communicates with a bottom part of said first cylindrical outer container of said drying furnace, and (2) a second cylindrical inner container which has a diameter smaller than that of said second cylindrical outer container and is arranged concentrically with said second cylindrical outer container, which has a port for taking out the adsorbent regenerated at an upper part thereof and a port for taking out the gas removed from the adsorbent at a part thereof being still higher than the adsorbent-taking out port, and a bottom part of which communicates with a bottom part of said first cylindrical inner container of said drying furnace, a portion of the communication being equipped with means for transporting the adsorbent from said drying furnace to said regenerating furnace.

3. An apparatus for regenerating an adsorbent as defined in claim 2, further comprising a pipe which is laid between the desorbed gas-outlet of said second cylindrical inner container and a fuel intake port of said combustor and which feeds the gas produced in said second cylindrical inner container to said combustor as part of fuel thereof.

4. An apparatus for regenerating an adsorbent as defined in claim 2, further comprising a heat exchanger which executes heat exchange between air for combustion introduced from the exterior and to be taken into said combustor and the regenerated adsorbent taken out of said regenerating furnace.

5. An apparatus for regenerating an adsorbent as defined in claim 2, wherein said drying furnace further comprises first heat transmitting tubes which penetrate said first cylindrical inner container, both ends of which are open to an interspace between said first cylindrical inner container and said first cylindrical outer container, and which are disposed in a plurality of stages in an axial direction of said drying furnace, the interspace between said first cylindrical outer container and said first cylindrical inner container being partitioned in a plurality of stages in the axial direction by first partition plates, the partitioned space of each stage being further divided by a second partition plate into two spaces communicating through said first heat transmitting tubes, said first partition plates being provided with holes so that all the spaces formed between said first cylindrical inner container and said first cylindrical outer container may join in series, and wherein said regenerating furnace further comprises second heat transmitting tubes which penetrate said second cylindrical inner container, both ends of which are open to an interspace between said second cylindrical inner container and said second cylindrical outer container, and which are disposed in a plurality of stages in an axial direction of said regenerating furnace, the interspace between said second cylindrical outer container and said second cylindrical inner container being partitioned in a plurality of stages in the axial direction by third partition plates, the partitioned space of each stage being further divided by a fourth partition plate into two spaces communicating through said second heat transmitting tubes, said third partition plates being provided with holes so that all the spaces formed between said second cylindrical inner container and said second cylindrical outer container may join in series.

6. An apparatus for regenerating an adsorbent as defined in claim 5, wherein each of said first cylindrical inner container and said second cylindrical inner container further comprises vanes which stir the adsorbent in the corresponding cylindrical inner container, which are disposed in a plurality of stages in the axial direction on a rotary shaft rotatably mounted in the corresponding cylindrical inner container, and which are inclined relative to a rotational direction thereof so as to bestow dynamic lifts on the adsorbent during rotation.

7. An apparatus for regenerating an adsorbent as defined in claim 6, wherein said vanes, said first heat transmitting tubes and said second heat transmitting tubes of the adjacent stages extend orthogonally to each other, respectively, a distance between said vanes of the adjacent stages in said first cylindrical inner container and a distance between said first heat transmitting tubes of the adjacent stages are substantially equal, and a distance between said vanes of the adjacent stages in said second cylindrical inner container and a distance between said second heat transmitting tubes of the adjacent stages are substantially equal.

8. An apparatus for regenerating an adsorbent, comprising:

a combustor for producing a high-temperature gas for heating the adsorbent, a drying furnace for removing water contained in the adsorbent, and including;

(1) a first cylindrical outer container which has an outlet for the high-temperature gas at an upper part thereof, (2) a first cylindrical inner container which has a diameter smaller than that of said first cylindrical outer container and is arranged concentrically with said first cylindrical outer container, and which has at its upper part a port for feeding the adsorbent and an outlet for water vapor produced from the adsorbent, (3) first heat transmitting tubes which penetrate said first cylindrical inner container, both ends of which are open to an interspace between said first cylindrical inner container and said first cylindrical outer container, and which are disposed in a plurality of stages in an axial direction of said drying furnace, said first heat transmitting tubes of the adjacent stages extending orthogonally to each other, and (4) first vanes which stir the adsorbent in said first cylindrical inner container, which are disposed in a plurality of stages in the axial direction on a rotary shaft rotatably mounted in said first cylindrical inner container, said first vanes of the adjacent stages extending orthogonally to each other, and which are inclined relative to a rotational direction thereof so as to bestow dynamic lift on the adsorbent during rotation, a distance between said first vanes of the adjacent stages and a distance between said first heat transmitting tubes of the adjacent stages being substantially equal, the interspace between said first cylindrical outer container and said first cylindrical inner container being partitioned in a plurality of stages in the axial direction by first partition plates, the partitioned space of each stage being further divided by a second partition plate into two spaces communicating through said first heat transmitting tubes, said first partition plates being provided with holes so that all the spaces formed between said first cylindrical inner container and said second cylindrical outer container may join in series, a regenerating furnace for removing adsorbed matter contained in the adsorbent, and including;

(1) a second cylindrical outer container which has at its upper part a port for taking the high-temperature gas from said combustor thereinto, and a bottom part of which communicates with a bottom part of said first cylindrical outer container of said drying furnace, (2) a second cylindrical inner container which has a diameter smaller than that of said second cylindrical outer container and is arranged concentrically with said second cylindrical outer container, which has a port for taking out the adsorbent regenerated at an upper part thereof and a port for taking out the gas removed from the adsorbent at a part thereof being still higher than the adsorbent-taking out port, the desorbed gas being fed to said combustor as part of fuel thereof, and a bottom part of which communicates with a bottom part of said first cylindrical inner container of said drying furnace, a portion of the communication being equipped with means for transporting the adsorbent from said drying furnace to said regenerating furnace, (3) second heat transmitting tubes which penetrate said second cylindrical inner container, both ends of which are open to an interspace between said second cylindrical inner container and said second cylindrical outer container, and which are disposed in a plurality of stages in an axial direction of said regenerating furnace, said second heat transmitting tubes of the adjacent stages extending orthogonally to each other, and (4) second vanes which stir the adsorbent in said second cylindrical inner container, which are disposed in a plurality of stages in the axial direction on a rotary shaft rotatably mounted in said second cylindrical inner container, said second vanes of the adjacent stages extending orthogonally to each other, and which are inclined relative to a rotational direction thereof so as to bestow dynamic lift on the adsorbent during rotation, a distance between said second vanes of the adjacent stages and a distance between said second heat transmitting tubes of the adjacent stages being substantially equal, the interspace between said second cylindrical outer container and said second cylindrical inner container being partitioned in a plurality of stages in the axial direction by third partition plates, the partitioned space of each stage being further divided by a fourth partition plate into two spaces communicating through said second heat transmitting tubes, said third partition plates being provided with holes so that all the spaces formed between said second cylindrical inner container and said second cylindrical outer container may join in series, and a heat exchanger which executes heat exchange between air for combustion introduced from the exterior and to be taken into said combustor and the regenerated adsorbent taken out of said regenerating furnace.

9. An apparatus for regenerating an adsorbent, comprising:

a combustor for producing a high-temperature gas for heating the adsorbent, a drying furnace for removing water contained in the adsorbent, and including:

(1) a first cylindrical outer container which has an outlet for the high-temperature gas at an upper part thereof and has an inlet for the high-temperature gas at the bottom part thereof, and (2) a first cylindrical inner container which has a diameter smaller than that of said first cylindrical outer container and is arranged concentrically with said first cylindrical outer container, and which has at its upper part a port for feeding the adsorbent and an outlet for water vapor produced from the adsorbent and has at its bottom part a port for taking out the adsorbent, a regenerating furnace for removing adsorbed matter contained in the adsorbent dried in said drying furnace, said regenerating furnace having at its upper part a port for taking out the adsorbent regenerated and a port for taking out the gas produced from the adsorbent and at its lower part a port for feeding the adsorbent, and means for conveying adsorbent dried in said drying furnace to said regenerating furnace through the port for taking out the adsorbent from said drying furnace and the port for feeding the adsorbent into said regenerating furnace.

10. An apparatus for regenerating an adsorbent as defined in claim 9, wherein said drying furnace further comprises first heat transmitting tubes which penetrate said first cylindrical inner container, both ends of which are open to an interspace between said first cylindrical inner container and said first cylindrical outer container, and which are disposed in a plurality of stages in an axial direction of said drying furnace, the interspace between said first cylindrical outer container and said first cylindrical inner container being partitioned in a plurality of stages in the axial direction by first partition plates, the partitioned space of each stage being further divided by a second partition plate into two spaces communicating through said first heat transmitting tubes, said first partition plates being provided with holes so that all the spaces formed between said first cylindrical inner container and said first cylindrical outer container may join in series.

11. An apparatus for regenerating an adsorbent as defined in claim 10, wherein said first cylindrical inner container further comprises vanes which stir the adsorbent in said first cylindrical inner container, which are disposed in a plurality of stages in the axial direction on a rotary shaft rotatably mounted in said first cylindrical inner container, and which are inclined relative to a rotational direction thereof so as to bestow dynamic lift on the adsorbent during rotation.

12. An apparatus for regenerating an adsorbent as defined in claim 11, wherein said vanes and said first heat transmitting tubes of the adjacent stages extend orthogonally to each other, respectively and, a distance between said vanes of the adjacent stages in said first cylindrical inner container and a distance between said first heat transmitting tubes of the adjacent stages are substantially equal.

13. An apparatus for regenerating an adsorbent, comprising:

a combustor for producing a high-temperature gas for heating the adsorbent, a drying furnace for removing water contained in the adsorbent, said drying furnace having at its upper part a port for feeding the adsorbent and at its lower part a port for taking out the adsorbent, a regenerating furnace for removing adsorbed matter contained in the adsorbent, and including, (1) a cylindrical outer container which has at its upper part a port for taking the high-temperature gas from said combustor thereinto, and has at its bottom part a port for taking out the high-temperature gas from said cylindrical outer container, and (2) a cylindrical inner container which has a diameter smaller than that of said cylindrical outer container and is arranged concentrically with said cylindrical outer container, which has a port for taking out the adsorbent regenerated at an upper part thereof and a port for taking out the gas removed from the adsorbent at a part thereof being still higher than the adsorbent-taking out port, and has a port for taking the adsorbent dried in said drying furnace at the bottom part thereof, and means for conveying adsorbent dried in said drying furnace to said regenerating furnace through the port for taking out the adsorbent from said drying furnace and the port for taking the adsorbent into said regenerating furnace.

14. The apparatus for regenerating an adsorbent as defined in claim 14, wherein said regenerating furnace further comprises heat transmitting tubes which penetrate said cylindrical inner container, both ends of which are open to an interspace between said cylindrical inner container and said cylindrical outer container, and which are disposed in a plurality of stages in an axial direction of said regenerating furnace, the interspace between said cylindrical outer container and said cylindrical inner container being partitioned in a plurality of stages in the axial direction by partition plates, the partitioned space of each stage being further divided by a further partition plate into two spaces communicating through said heat transmitting tubes, said first-mentioned partition plates being provided with holes so that all the spaces formed between said cylindrical inner container and said cylindrical outer container may join in series.

15. An apparatus for regenerating an adsorbent as defined in claim 14, wherein said cylindrical inner container further comprises vanes which stir the adsorbent in said cylindrical inner container, which are disposed in a plurality of stages in the axial direction on a rotary shaft rotatably mounted in said cylindrical inner container, and which are inclined relative to a rotational direction thereof so as to bestow dynamic lift on the adsorbent during rotation.

16. An apparatus for regenerating an adsorbent as defined in claim 15, wherein said vanes and said heat transmitting tubes of the adjacent stages extend orthogonally to each other, respectively, and a distance between said vanes of the adjacent stages in said cylindrical inner container and a distance between said heat transmitting tubes of the adjacent stages are substantially equal.

* * * * *